US006436272B1

(12) United States Patent
Brown et al.

(10) Patent No.: US 6,436,272 B1
(45) Date of Patent: Aug. 20, 2002

(54) LOW TEMPERATURE ALUMINUM REDUCTION CELL USING HOLLOW CATHODE

(75) Inventors: Craig W. Brown; Patrick B. Frizzle, both of Seattle, WA (US)

(73) Assignee: Northwest Aluminum Technologies, Seattle, WA (US)

( * ) Notice: Subject to any disclaimer, the term of this patent is extended or adjusted under 35 U.S.C. 154(b) by 84 days.

(21) Appl. No.: 09/678,238

(22) Filed: Oct. 4, 2000

Related U.S. Application Data

(63) Continuation-in-part of application No. 09/247,196, filed on Feb. 9, 1999, now Pat. No. 6,258,247.

(51) Int. Cl.[7] ..... C25C 3/16

(52) U.S. Cl. ..... 205/374; 205/376; 205/378; 205/380; 205/386; 205/387; 205/394; 205/395; 205/396; 204/243.1; 204/244; 204/245; 204/247.3; 204/247.4; 204/280

(58) Field of Search ..... 205/374, 376, 205/378, 380, 386, 387, 394, 395, 396; 204/243.1, 244, 245, 247.3, 247.4, 280

(56) References Cited

U.S. PATENT DOCUMENTS

| | | | | |
|---|---|---|---|---|
| 842,256 | A | 1/1907 | Seward et al. | |
| 1,534,317 | A | 4/1925 | Hoopes et al. | |
| 1,534,320 | A | 4/1925 | Hoopes et al. | |
| 1,534,322 | A | 4/1925 | Hoopes et al. | |
| 1,535,458 | A | 4/1925 | Frary | |
| 3,725,222 | A | 4/1973 | Russell et al. | 204/67 |
| 4,165,272 | A | 8/1979 | Cunningham | 204/282 |

(List continued on next page.)

FOREIGN PATENT DOCUMENTS

| | | |
|---|---|---|
| GB | 542886 | 1/1942 |
| GB | 970360 | 9/1964 |
| WO | 9941431 | 8/1999 |

OTHER PUBLICATIONS

Haupin, Warren E., "Principles of Aluminum Electrolysis," Light Metals 1995, pp. 195–203, No month available.

Brown, Craig W., "The Wettability of $TiB_2$–Based Cathodes in Low–Temperature Slurry–Electrolyte Reduction Cells," Journal of the Minerals, Metals & Materials Society, May 1998, pp. 38–40.

Erzmetall, H.J. Dahlmann, "Ofen– und Prozessführung beim Einsatz von physikalisch und chemisch variablen Oxidprovenienzen in der Aluminiumelektrolyse," vol. 31, No. 11, 1978, pp. 515–517 (with English abstract) No month available.

Chemical Abstracts, vol. 124, No. 12, Mar. 18, 1996, Abstract No. 151491, P. Chin et al., "The Transfer of Nickel, Iron, and Copper from Hall Cell Melts to Molten Aluminum".

Chemical Abstracts, vol. 97, No. 14, Oct. 4, 1982, Abstract No. 117391, D. Bratland et al., "The Solubility of Vanadiam Pentoxide in Molten Cryolite–Alumina and the Aluminothermic Reduction of Vanadium Pentoxide".

Chemical Abstracts, vol. 82, No. 10, Mar. 10, 1975, Abstract No. 66050, S. Zuca et al., "Physical and Chemical Properties of the Electrolyte Used in the Electrolytical Production of Aluminum".

*Primary Examiner*—Bruce F. Bell
(74) *Attorney, Agent, or Firm*—Andrew Alexander

(57) ABSTRACT

A method of producing aluminum in an electrolytic cell containing alumina dissolved in an electrolyte. A plurality of non-consumable anodes are disposed substantially vertically in the electrolyte along with a plurality of monolithic hollow cathodes. Each cathode has a top and bottom and the cathodes are disposed vertically in the electrolyte and the anodes and the cathodes are arranged in alternating relationship. Each of the cathodes is comprised of a first side facing a first opposing anode and a second side facing a second opposing anode. The first and second sides are joined by ends to form a reservoir in the hollow cathode for collecting aluminum therein deposited at the cathode.

46 Claims, 4 Drawing Sheets

U.S. PATENT DOCUMENTS

| | | | | |
|---|---|---|---|---|
| 4,399,008 | A | 8/1983 | Ray | 204/67 |
| 4,462,889 | A | 7/1984 | Landon et al. | 204/292 |
| 4,592,812 | A | 6/1986 | Beck et al. | 204/67 |
| 4,600,481 | A | 7/1986 | Sane et al. | 204/67 |
| 4,740,279 | A | 4/1988 | Müller et al. | 204/68 |
| 4,861,671 | A | 8/1989 | Muchnik et al. | 428/457 |
| 4,865,701 | A | 9/1989 | Beck et al. | 204/67 |
| 5,006,209 | A | 4/1991 | Beck et al. | 204/67 |
| 5,284,562 | A | 2/1994 | Beck et al. | 204/243 |
| 5,294,306 | A | 3/1994 | Howard et al. | 204/70 |
| 5,368,702 | A | 11/1994 | deNora | 204/67 |
| 5,378,325 | A | 1/1995 | Dastolfo, Jr. et al. | 204/66 |
| 5,415,742 | A | 5/1995 | LaCamera et al. | 204/1.11 |
| 5,498,320 | A | 3/1996 | Rendall | 205/385 |
| 5,720,868 | A | 2/1998 | Rendall et al. | 205/372 |
| 5,855,757 | A | 1/1999 | Sivilotti | 205/367 |
| 5,873,993 | A | 2/1999 | Stubergh | 205/364 |
| 6,103,091 | A | 8/2000 | Sekhar et al. | 205/387 |

LOW TEMPERATURE ALUMINUM REDUCTION CELL USING HOLLOW CATHODE

CROSS REFERENCE TO RELATED APPLICATIONS

This application is a continuation-in-part of U.S. Ser. No. 09/247,196, filed Feb. 9, 1999. Now U.S. Pat. No. 6,258,247.

The invention embodied in the subject matter described herein was made during work financed by the following government contracts: Battelle Pacific Northwest National Laboratory Contract #320879-AF2; and Department of Energy Office of Industrial Technologies Contract #DE-FC07-98ID13662

BACKGROUND OF THE INVENTION

This invention relates to a low temperature aluminum reduction cell and more particularly, it relates to a low temperature aluminum reduction cell using an improved method for removing molten aluminum from the cell.

The present invention relates generally to methods and apparatuses for the electrolytic reduction of alumina to aluminum. More particularly, the subject matter herein relates to the subject matter disclosed in Beck et al. U.S. Pat. No. 4,592,812; 4,865,701; 5,006,209; 5,284,562; and U.S. patent application Ser. No. 09/247,196, the disclosures thereof which are incorporated herein by reference.

The aforementioned patents of Beck et al. are directed to a series of developments relating to the electrolytic reduction of alumina to aluminum. The developments culminated in an electrolytic reduction cell containing a relatively low melting point, molten electrolyte composed of fluorides, a non-consumable anode composed of a particular alloy of copper, nickel and iron, and a cathode, composed of titanium diboride ($TiB_2$), that is wettable by molten aluminum. A plurality of the non-consumable anodes are vertically disposed within a vessel containing a bath composed of molten electrolyte. A plurality of the cathodes are also vertically disposed within the vessel, with the cathodes being arranged in close, alternating, spaced relation with the vertically disposed anodes. In a preferred embodiment, the vessel has an interior metal lining electrically connected to the anodes and having essentially the same composition as the anodes. The lining can function as an auxiliary anode.

The bath of molten electrolyte contains dissolved alumina and additional alumina in the form of finely divided particles. The molten electrolyte has a density less than the density of molten aluminum and less than the density of alumina. As noted above, some alumina is dissolved in the molten electrolyte. When an electric current is passed through the bath, aluminum ions are attracted to the cathodes, and oxygen ions are attracted to the anodes. Bubbles of gaseous oxygen form at each of the anodes, and aluminum forms at each of the cathodes. The bubbles of gaseous oxygen pass upwardly from the anodes and maintain the undissolved, finely divided alumina particles suspended in the bath of molten electrolyte, forming a slurry. The metallic aluminum formed at the cathodes wets the surface of each cathode and flows downwardly along the cathode.

The electrolytic reduction cell is operated at a relatively low temperature, substantially below 950° C. The composition of the electrolyte employed in the cell enables operation of the cell at a relatively low temperature, because the electrolyte is molten at that low temperature. The low cell temperature allows the use of non-consumable anodes composed of the Ni—Cu—Fe alloys described below without subjecting the anodes to deterioration in the molten electrolyte.

In conventional electrolytic cells for production of aluminum from alumina, molten aluminum is removed by tapping the cell periodically by removal of a plug in the bottom of the cell where the molten aluminum has collected. In such cells, the density of the molten aluminum is greater than the density of the electrolyte. Consequently, molten aluminum collects on the floor of the cell which may be comprised of the cathode. In another embodiment, the aluminum is removed by siphoning molten aluminum from the pool of metal collected on the cell floor. However, when the aluminum is not permitted to collect on the floor of the cell, then its removal becomes much more difficult and thus various processes have been proposed.

U.S. patent application Ser. No. 09/247,196 discloses capillary action for collecting metal product. One problem with capillary action is clogging of the capillary conduit which can result from freezing of the electrolyte when a shift in current density occurs. Another problem resides in removing metal from the capillaries because the molten metal is drawn towards the smallest cross section. In addition, there is the problem of excluding alumina particles from the product metal when an alumina slurry electrolyte is used with capillaries.

U.S. Pat. No. 5,284,562 discloses an oxidation resistant, non-consumable anode, for use in the electrolytic reduction of alumina to aluminum, that has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF. In this patent, one embodiment of a removal device is a pierced, titanium diboride member 31 which is wet internally and externally by aluminum and is mounted in the lower, inlet end of a suction tube 32 disposed above tap location 34. Member 31 has a lower-most extremity at tap location 34. A sump (not shown) may be provided at tap location 34 to assist in accumulating molten aluminum there. Titanium diboride member 31 will remove molten aluminum from the cell.

U.S. Pat. No. 4,740,279 relates to a process of producing lithium metal by the electrolysis of fused mixed salts comprising electrolyzing fused mixed salts consisting of lithium chloride and potassium chloride in a diaphragmless electrolytic cell, withdrawing molten lithium metal from the cell to a receiver and cooling the lithium metal which has been withdrawn. To decrease the content of impurities in a continuous process, molten mixture which rises in the inter-electrode space in the cell and contains lithium metal is collected in an annular zone, which surrounds the top end of the cathode adjacent to the surface level of the molten mixture, the molten mixture is withdrawn from the annular zone through a siphon pipe and is supplied from the latter to a separating chamber, which communicates with the electrolytic cell and is sealed from the chlorine gas atmosphere in the electrolytic cell. Electrolyte and lithium are separated in the separating chamber under a protective gas atmosphere. Lithium metal is discharged from the separating chamber into a receiver under a protective gas atmosphere and the electrolyte is recycled from the separating chamber to the electrolytic cell.

U.S. Pat. No. 4,165,272 discloses an electrolytic cell cathode having a hollow cathode finger with fins extending outwardly therefrom for electrolysis of alkali metal chlorides. A synthetic separator surrounds the cathode and rests upon the fin-like extensions.

U.S. Pat. No. 4,681,671 discloses a method of producing aluminum by electrolysis of alumina dissolved in molten cryolite at temperatures between 680°–690° C.

The method comprises the employment of permanent anodes the total surface of which is increased up to 5 times compared to the total surface of anodes in a classical Hall-Heroult cell of comparable production rate. By this means the anodic current density is lowered to a degree which permits the discharge of oxide ions preferentially to fluoride ions at an acceptable rate. Additionally, the electrolyte is circulated by suitable means whereby it passes from an enrichment zone where it is saturated with alumina to an electrolysis zone and back.

U.S. Pat. No. 5,498,320 discloses a method and apparatus for electrolytic reduction of alumina using a porous cathode. The patent discloses in aluminum smelting by electrolysis, a double salt of $KAlSO_4$, as a feedstock, heated with a eutectic electrolyte, such as $K_2SO_4$, at 800° C. for twenty minutes to produce an out-gas of $SO_3$ and a liquid electrolyte of $K_2SO_4$ with fine-particles of $Al_2O_3$ in suspension having a mean size of six to eight microns. This is pumped into a cell with an electrolyte comprised of $K_2SO_4$ with fine-particles of $Al_2O_3$ in suspension, an anode and a porous cathode of open-cell ceramic foam material. The cell is maintained at 750° C. and four volts of electricity applied between the anode and the cathode causes oxygen to bubble at the anode and liquid aluminum to form in the porous cathode. A channel within the porous cathode, and the porous cathode itself, are deep enough within the cell electrolyte that the pressure head of electrolyte is enough to overcome the difference in density between the molten aluminum and the electrolyte to pump molten aluminum from the channel out of the side of the cell. The electrolyte $K_2SO_4$ is periodically bled-off to control a build-up of the material as aluminum is produced form the double salt of $K_2SO_4$.

U.S. Pat. No. 5,855,757 discloses a process for the production of a molten metal by electrolysis in an electrolytic cell having an electrolysis compartment, a metal recovery compartment, and a partition separating upper parts of the compartments, the process comprising: electrolysing in the electrolysis compartment an electrolyte containing a fused salt of the metal the electrolyte being of greater density than the metal; continuously withdrawing the product metal mixed with the electrolyte in a stream from the electrolysis compartment to a top part of the metal recovery compartment; allowing the metal to form in the metal recovery compartment as a pad floating on the electrolyte; maintaining the pad out of contact with the partition; and recovering the pad.

U.S. Pat. No. 5,368,702 discloses a multimonopolar cell for electrowinning aluminum by the electrolysis of alumina dissolved in a molten salt electrolyte, comprises electrode assemblies each having a non-consumable anode and a non-consumable cathode both resistant to attack by the electrolyte and by the respective product of electrolysis. The anode (2) is preferably of tubular form with an active anode surface (7) inside, and the cathode is made of one or more rods (1) or tubes placed in the middle of the tubular anode or between plate anodes, the cathode extending beyond the bottom of the anode.

U.S. Pat. No. 5,415,742 discloses a process for electrowinning metal in a low temperature melt. The process utilizes an inert anode for the production of metal such as aluminum using low surface area anodes at high current densities.

SUMMARY OF THE INVENTION

It is an object of this invention to provide an improved electrolytic smelting cell for producing aluminum from alumina.

It is another object of this invention to provide an improved means for collecting molten aluminum produced from alumina in a low temperature electrolytic cell.

It is still another object of the invention to provide a cathode collection means for collecting molten aluminum produced from alumina in a low temperature (less than 900° C.) electrolytic cell employing an inert anode.

Yet, it is still another object of this invention to provide a hollow cathode for collecting molten aluminum therein produced from alumina in an electrolytic cell employing an inert anode.

And yet, it is still another object of the invention to provide an improved process for producing aluminum from alumina in a low temperature electrolytic cell employing an inert anode and an electrolyte containing alumina in an amount greater than solubility and a hollow cathode for collecting molten aluminum therein.

These and other objects will become apparent from a reading of the specification and claims appended hereto.

In accordance with these objects, there is provided a method of producing aluminum in an electrolytic cell containing alumina dissolved in an electrolyte, the method comprising the steps of providing a molten salt electrolyte having alumina dissolved therein in an electrolytic cell having a liner for containing the electrolyte, the liner having a bottom and walls, the liner being substantially inert with respect to the molten electrolyte. A plurality of non-consumable anodes are disposed substantially vertically in the electrolyte along with a plurality of hollow cathodes. Each cathode has a top and bottom. The cathodes are disposed vertically in the electrolyte and the anodes and the cathodes are arranged in alternating relationship. The anodes have a substantially plate-shaped configuration. Each of the cathodes is comprised of a first side facing a first opposing anode and a second side facing a second opposing anode. The first and second sides are joined by ends to form a reservoir in the hollow cathode, the cathode having a bottom opening and a top opening into the reservoir. An electric current is passed from the anodes, through the electrolyte to the cathodes, depositing aluminum on the cathodes and oxygen bubbles are generated at the anodes, the bubbles stirring the electrolyte. Molten aluminum is deposited at the cathodes and collected in the reservoir in the hollow cathodes. A portion of the molten aluminum is withdrawn from the reservoir through the top opening.

DETAILED DESCRIPTION OF THE PREFERRED EMBODIMENTS

Figure 1:
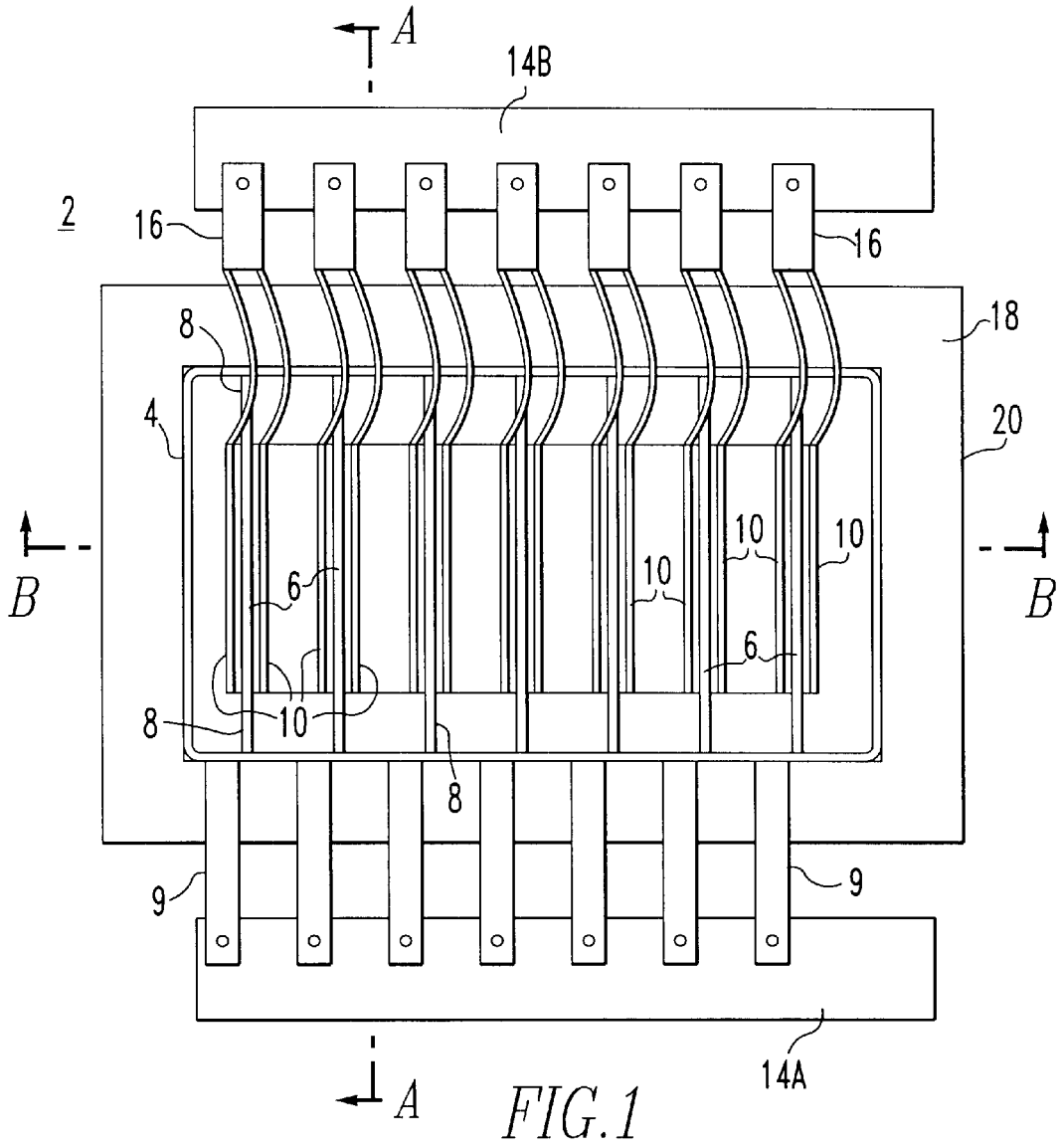
FIG. 1 is a plan view illustrating an embodiment which may be used in the practice of the invention.

In FIG. 1, there is shown a top or plan view of an embodiment of the invention which illustrates an electrolytic cell 2 for the electrolytic production of aluminum from alumina dissolved in an electrolyte contained in the cell. Cell 2 comprises a metal or alloy liner 4 having bottom and sides for containing electrolyte. Non-consumable or inert anodes 6 are shown mounted vertically inside liner 4 which preferably has the same composition as anodes 6. Further, as shown in FIG. 1, anodes 6 are connected to liner 4 by means of straps 8 to provide an electrical connection therebetween. Also, liner 4 is shown connected to bus bar 14A by electrical conducting strap 9. Cathodes 10 are shown positioned on either side of anodes 6. Cathodes 10 are electrically connected to bus bar 14B by appropriate connection means such as straps 16. Liner 4 is layered with thermal insulating material 18 such as insulating fire brick which is contained with a metal shell 20.

In operation, electrical current from bus bar 14A flows through electrical strap 9 into anodic liner 4. Current from liner 4 flows through conducting straps 8 to anodes 6 then through an electrolyte to cathodes 10. The current then flows from cathodes 10 along connection means 16 to a second bus bar 14B. Additional electrolytic cells may be connected in series on each side of cell 2. The cell may be operated at a current density in the range of 0.1 to 10 Å/cm$^2$ and typically 0.5 to 5 Å/cm$^2$.

While any inert anode including cermets or metal alloys may be used in the electrolytic cell of the invention, it is preferred that the anode material including the anodic liner be comprised of Cu—Ni—Fe compositions that have resistance to oxidation by the electrolyte. Suitable anode compositions are comprised of 25–70 wt. % Cu, 15–60 wt. % Ni and 1–40 wt. % Fe. Within this composition, a preferred anode composition is comprised of 45–70 wt. % Cu, 25–48 wt. % Ni and 2–17 wt. % Fe with typical compositions comprising 45–70 wt. % Cu, 28–42 wt. % Ni and 13–17 wt. % Fe.

It will be understood that a number of anodes and cathodes can be employed with the anodes and cathodes used in alternating relationship.

Figure 2:
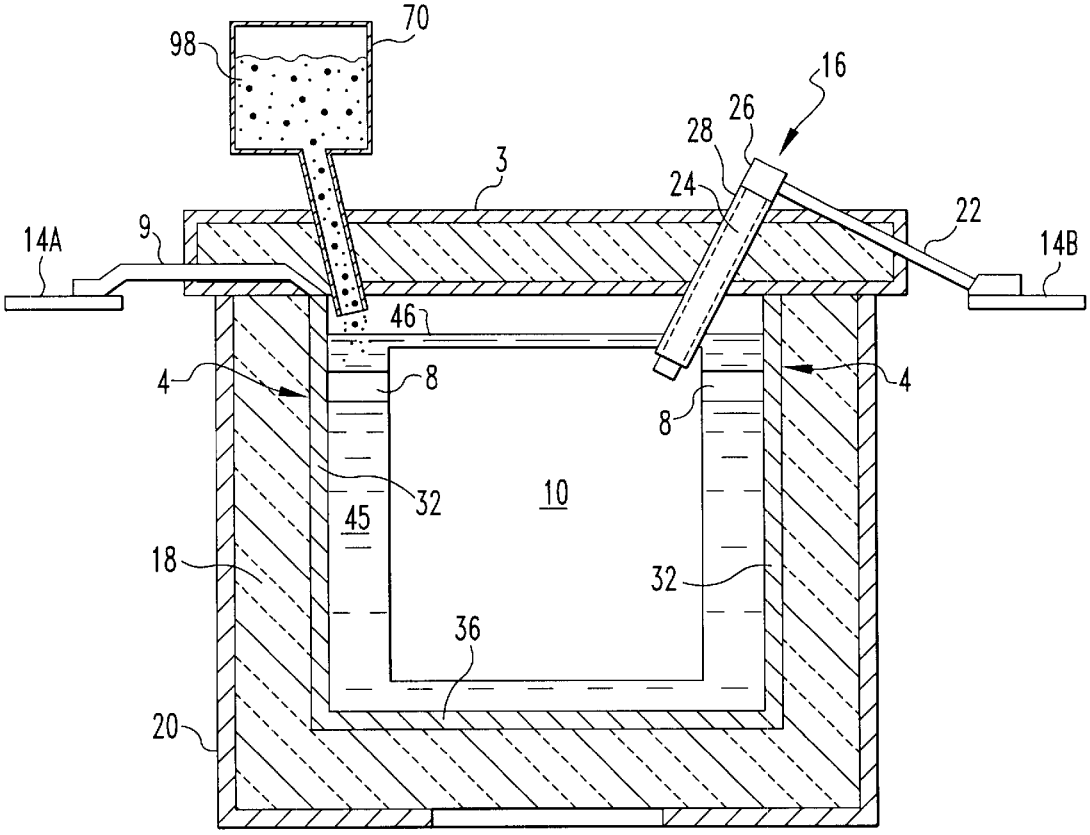
FIG. 2 is a cross-sectional view of an electrolytic cell along line A—A of FIG. 1.

FIG. 2 is a cross-sectional view along line A—A of FIG. 1 showing anodic liner 4, straps 8 connecting anodes to the liner, cathode 10, strap 9 connecting liner 4 to bus bar 14A and insulation 18 contained between anodic liner 4 and metal shell 20. Also, shown in FIG. 2 is electrical connection means 16 used to connect cathodes 10 to bus bar 14B. Connection means 16 may be comprised of a flexible metal strap 22 which is connected to bus bar 14B. Flexible metal strap 22 is connected to cathode 10 by collector bars 24 which are slotted on the bottom and straddle or fit over cathode 10. Strap 22 is connected to collector bar 24 utilizing an aluminum cap 26. That is, aluminum cap 26 is cast on collector bar 24 and strap 22 is welded thereto. Electrical connection between the cathode and collector bar may be provided by using aluminum metal at the connection. That is, aluminum metal becomes molten at cell operating temperature and wets both the cathode and collector bar, particularly if both cathode and collector bar are fabricated from titanium diboride. To guard against air burn of collector bar 24 during operation, a sleeve or tube of alumina 28 or like material may be used to cover or surround collector bar 24.

Referring further to FIG. 2, it will be seen that anodic liner 4 has vertical sides 32 and bottom referred to generally as 36.

Cathodes 10 are shown positioned under surface 46 of electrolyte 45 and spaced substantially equally from sides 32 of liner 4. Cathodes may be comprised of a material selected from titanium diboride, zirconium boride, titanium carbide, zirconium carbide, molybdenum and titanium.

A source of alumina 98 may be added to the cell from hopper 70 to provide the desired concentration of alumina in the electrolyte.

The amount of alumina in the electrolyte can range from that amount which provides saturation of an excess of alumina. Thus, undissolved alumina can range from 0.2 to 30 wt. % in the electrolyte and the alumina particle size can range from about 1 to 100 microns. For purposes of operation, the cell preferably is maintained at a temperature lower than 900° C. and typically in the range of 660° to 800° C. The electrolyte can comprise $AlF_3$ and at least one salt from the group consisting of NaF, KF and LiF.

Figure 3:
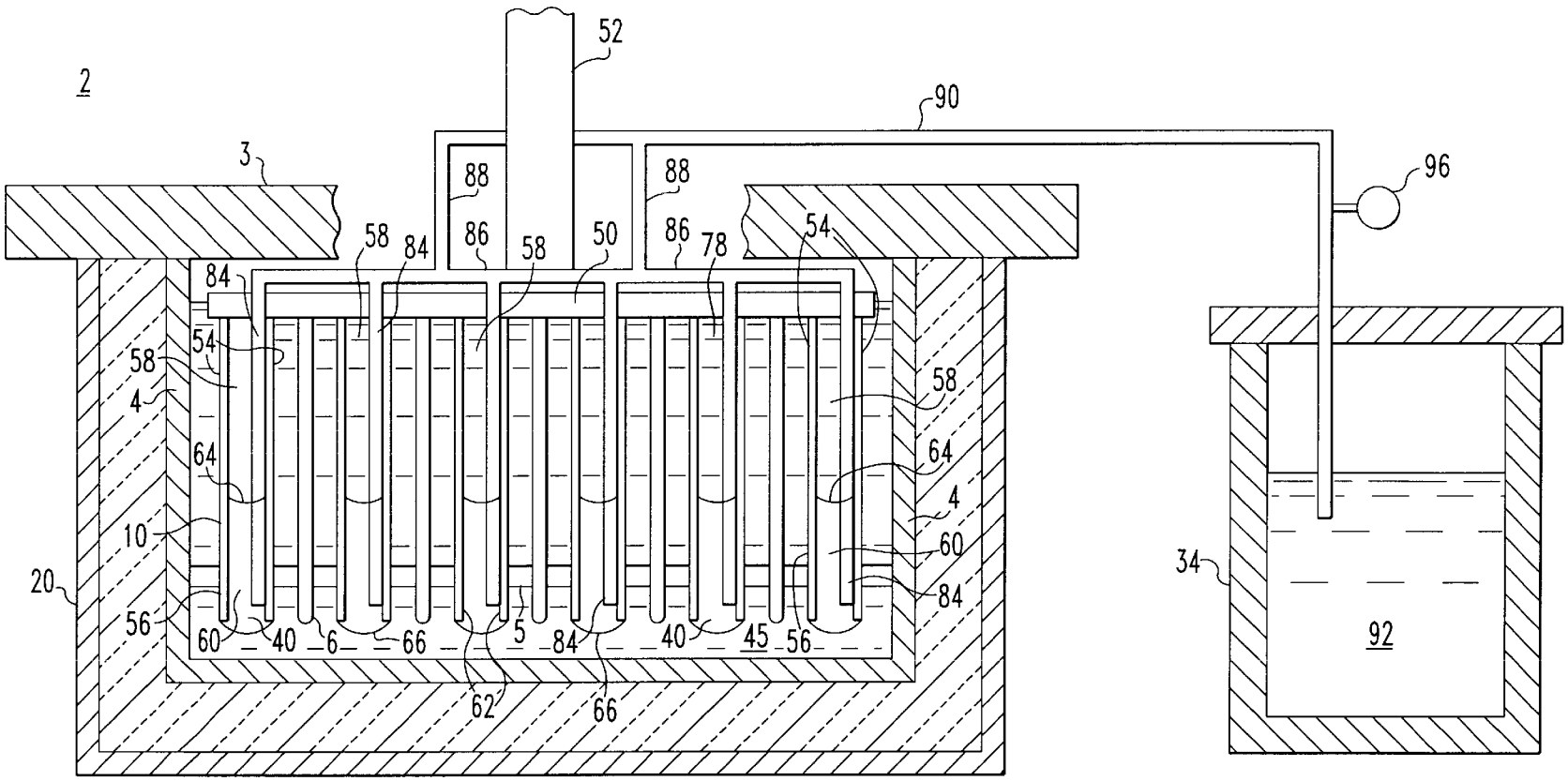
FIG. 3 is a cross-sectional view of an electrolytic cell along line B—B of FIG. 1.

FIG. 3 is a cross-sectional view along line B—B of FIG. 1 showing liner 4, anodes 6 and cathodes 10. A molten aluminum reservoir 34 is shown outside cell 2 for containing molten aluminum removed from cell 2. It should be noted that cathodes 10 are hollow and open at bottom 40 and interleaved with anodes across the extent of the cell. In addition, electrical insulative spacers 5 may be provided between the anode and cathode to ensure that the desired anode-cathode distance is maintained. In the present cell, typically the anode-cathode distance ranges from ¼ to 1 inch.

Referring to FIG. 3, it will be seen that anodes 6 and cathodes 10 are suspended from a support member 50 which is connected to shaft 52, which may be used for raising and lowering the anode-cathode assembly. When electric current is passed from anodic liner 4 to anodes 6 through electrolyte 45 to cathodes 10, aluminum is deposited at surfaces 54 of cathodes 10. Cathode surfaces 54 are wet by the molten aluminum. Consequently, molten aluminum deposited on the cathode collects at bottom portion 56 and flows into cathode bottom opening 40. As the molten aluminum collects at bottom portion 56, it enters bottom opening 40 and rises in cathode hollow 58, displacing electrolyte to provide a pool or body 60 of molten aluminum in cathode hollow or reservoir 58. That is, the use of hollow cathode 10 provides an integral pad of molten metal 60. The molten aluminum climbs inside walls 62 by capillary action and forms a meniscus 64. The molten aluminum wets inside surface 62 and rises in the hollow cathode until an equilibrium height is reached. That is, if the molten metal has a contact angle less than 90° with surface or walls 62, the molten aluminum rises in the hollow cathode to form a pad of molten aluminum integral with the cathode. It should be noted that the rise of molten aluminum in the hollow of the cathode is elevated by a second interface or meniscus associated with molten aluminum in the hollow cathode. As shown in FIG. 3, there is meniscus 64 which is located inside the hollow cathode. In addition, a second meniscus or interface 66 forms at bottom opening 40 of hollow cathode 10 where the molten aluminum enters the hollow cathode. The second interface forms because two liquids are present in the bath; namely, molten aluminum and molten salt which are substantially immiscible. The effect of the second interface is to increase the elevation of the molten aluminum in the hollow cathode. Further, elevation of molten aluminum in the hollow cathode is increased because the capillary action is present in a body of molten electrolyte or salt and the elevation of molten aluminum is not suppressed by atmospheric pressure. All of these features operate to improve the flow of molten aluminum from the outside surface of the cathode into the hollow cathode to create a cathode with an integral pad or reservoir of aluminum. Thus, aluminum deposited on outside surface 54 of cathode 10 drains to the bottom of the cathode and is collected in the hollow reservoir of the cathode.

Figure 4:
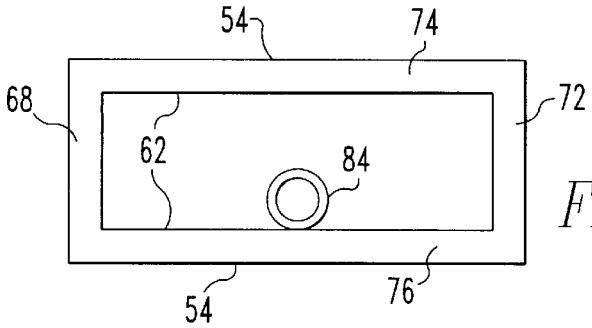
FIG. 4 is a cross-sectional view of a hollow cathode of the invention.
Figure 6:
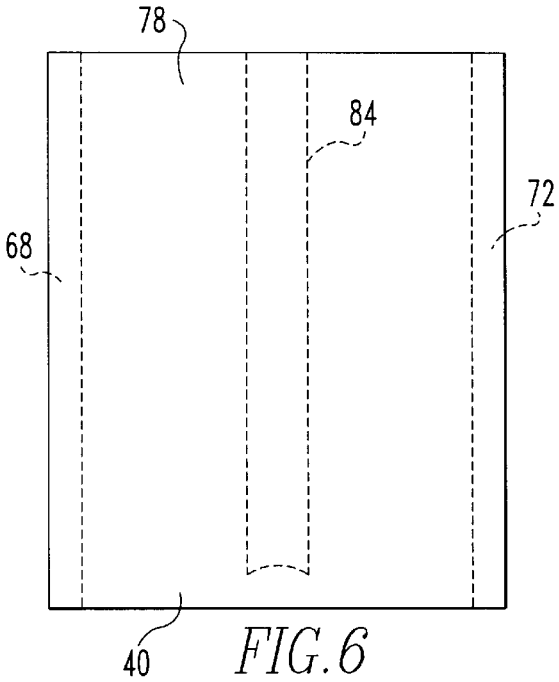
FIG. 6 is a side view of the hollow cathode of FIG. 4.
Figure 5:
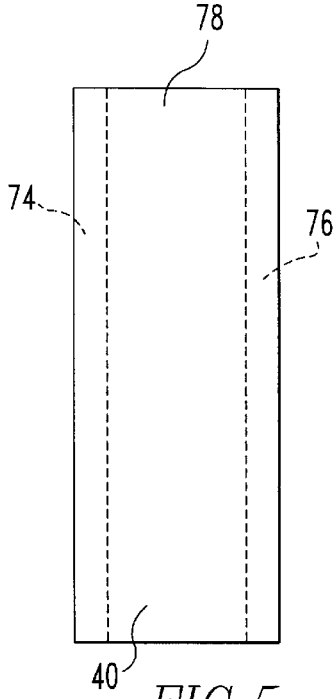
FIG. 5 is an end view of the hollow cathode of FIG. 4.

The preferred shape of the cathode is rectangular in cross section as shown in FIG. 4 where hollow cathode 10 is shown having outside surfaces 54 and inside surfaces or walls 62. In addition, cathode 10 requires end walls 68 and 72. End walls are necessary in order to define a reservoir or hollow in the cathode to collect or form a molten aluminum pad. If end walls are not present, there is substantial absence of a pad of metal. Or, if ends are not present, the side walls are required to be very close and prevent meaningful collection of a substantial pad of metal. In one aspect of the present invention, it is preferred that walls or sides 74 and 76 of cathode 10 are formed substantially parallel to each other (see FIG. 5). If desired, sides 74 and 76 may taper inwardly at the top to form a reservoir which is smaller in cross section at the top than at the bottom to encourage the capillary effect for increasing the height of the pool of metal contained in the hollow cathode. In another configuration, walls 74 and 76 may taper outwardly from bottom opening 40 and then taper inwardly towards top opening 78. Further, end walls 68 and 72 are preferred to be provided substantially parallel to each other (see FIG. 6). However, other configurations may be used.

Figure 7:
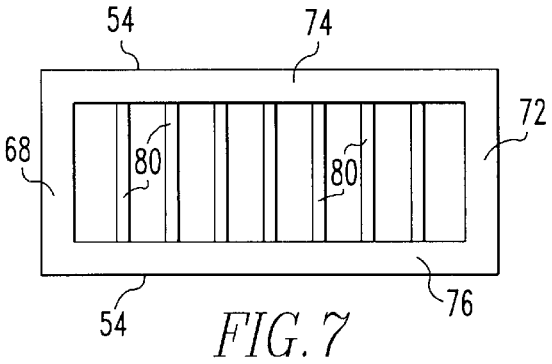
FIG. 7 is a cross-sectional view of a hollow cathode similar to FIG. 4 showing dividers in the cathode.
Figure 8:
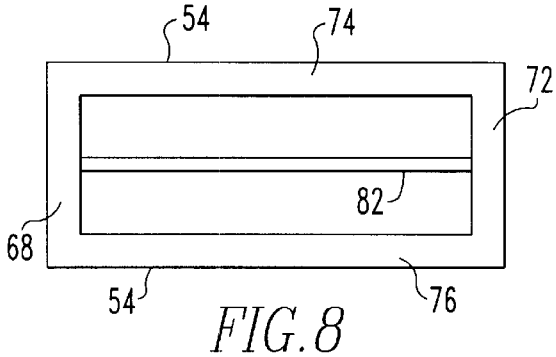
FIG. 8 is a cross-sectional view of a hollow cathode similar to FIG. 4 showing a single divider.

For purposes of collecting a pad of molten metal in the reservoir provided by hollow cathode 10, it is preferred that surfaces 62 of walls 74 and 76 be maintained about 0.25 to 3 inches and typically about 0.5 to 1 inch apart for purposes of collecting a substantial pool of molten metal and yet provide for meaningful capillary action for metal collected at bottom portion 56. Further, it is believed that cathode width dimension (distance between ends 68 and 72) is not limited and can extend across the cell for 60 or 70 inches, for example. It should be understood that it is important to use a capillary space which is as large as possible to avoid problems with clogging. Further, the larger capillary space allows alumina particles in the electrolyte to pass through the metal pad without displacing or contaminating the metal. In addition, a large capillary space permits the use of a tapping tube for metal removal. It should be understood that the distance or extent between the inside surfaces is only limited by the ability of the molten aluminum to bridge the distance between inside surfaces 62. For purposes of encouraging molten aluminum to bridge the opening between inside surfaces 62, a plurality of dividers 80 may be used as illustrated in FIG. 7. Divider 80 may be spaced ¼ or less to 1 inch apart. It will be appreciated that openings defined by dividers 80 may be any shape which aids collection of molten aluminum in the hollow cathodes. As shown in FIG. 8, divider 82 may extend from end wall 68 to end wall 72 or a combination of dividers 80 and 82 may be used.

Once the aluminum is collected in a metal pool or pad 60, it can be removed by any suitable means. In the present invention, a tube 84 is shown extending inside hollow cathode 10 into pool or pad 60 for purposes of removing molten aluminum therefrom. In the embodiment illustrated in FIG. 3, molten aluminum is removed using tubes 84. The molten aluminum is then directed along collection conduit 86 and pipes 88 into channel 90 which flows the molten aluminum into molten aluminum reservoir 34 to provide a body of molten aluminum 92.

Molten aluminum may be withdrawn from metal pad 60 by applying vacuum using vacuum pump 96. A vacuum up to 1 atm can be applied to line 90 to siphon molten aluminum from the hollow cathode. The vacuum may be applied continuously or intermittently for purposes of removing metal from the cell. It will be appreciated that the molten aluminum removal route is illustrative and that different routes may be employed and such are contemplated within the purview of the invention. It is important in removing molten aluminum from the integral pad 60 that the piping be maintained above the melting point of aluminum to avoid solidification prior to it being deposited in reservoir 34. Thus, piping or conduits may be located under lid 3 prior to entering reservoir 34 to minimize the amount of heat required to be added.

While the invention has been described with respect to aluminum deposited at the cathode entering the hollow cathode through bottom opening 40, a portion of the aluminum may enter the hollow cathode through top opening 78 and such is contemplated within the purview of the invention.

Thus, it will be seen that a system for producing aluminum in an electrolytic cell containing alumina dissolved in an electrolyte is provided. The system is comprised of an electrolytic cell having a liner for containing a molten salt electrolyte having alumina dissolved therein, the liner being substantially inert with respect to the molten electrolyte. Further, the system is comprised of a plurality of non-consumable anodes disposed substantially vertically in the electrolyte in the cell and a plurality of hollow cathodes disposed vertically in the electrolyte, the anodes and the cathodes arranged in alternating relationship. Each cathode has a top and a bottom and is comprised of a first side facing a first opposing anode and a second side facing a second opposing anode. The first and second sides are joined by ends to form a reservoir in the hollow cathode, the cathode having a bottom opening and a top opening into the reservoir.

In the system, means is provided for passing an electric current from the anodes, through the electrolyte to the hollow cathodes, in response to passing electric current through the electrolyte, aluminum is deposited on the cathodes, and oxygen bubbles are generated at the anodes, the bubbles stirring the electrolyte. The aluminum deposited at the cathode is collected in molten form in the reservoir. In the system, means is provided for withdrawing a portion of the molten aluminum from the reservoir or hollow cathode.

The hollow cathode may be fabricated from flat plates or walls 74 and 76 which are fastened or joined to end walls 68 and 72. Fasteners or welding may be used to join the plates, depending on the material used for the cathode. In another embodiment of the invention, the hollow cathode may be formed by extruding or casting a hollow, rectangular-shaped tube having the cathode configuration.

The following examples are further illustrative of the invention.

EXAMPLE 1

A number of experiments were performed using a protected alumina crucible to hold electrolyte. The experiments were conducted with about 5–40 amperes of electrolysis current. During the electrolysis, the cell temperature in these tests was about 730° C. Molybdenum (Mo) was used to form hollow cathodes. A low-melting bath was used comprising about 47 mole % aluminum fluoride ($AlF_3$) and about 53 mole % potassium fluoride (KF) with about a 10% excess of undissolved alumina. This electrolyte remains molten at temperatures below the melting point of aluminum and allowed aluminum to be frozen in-situ before a test cathode was removed from the bath.

In the first of these small-cell experiments, the cathode was comprised of four plates of Mo, each nominally 1"×4" (2.5 cm×10.2 cm) and 0.090" (0.23 cm) thick, arranged to provide a square cross section of nominal dimensions 1"×1" (2.5 cm×2.5 cm) in which the metal pad could accumulate. These sections defined hollow cathodes. In this experiment, a metal pad formed and the impressions of the Mo cathodes could be seen in the aluminum solidified in the hollow cathode.

Subsequent small-cell tests used hollow, cylindrical Mo cathodes, each about 4" (10.2 cm) in length and of material about 0.125" (0.32 cm) thick. One test lasted 4.5 hours and another test lasted 2.67 hours at 22 amperes. Another of these tests used 6.5 amperes and lasted 6 hours. Each cathode was sectioned and it was shown that an aluminum pad was obtained by in-situ freezing of the product metal in the hollow cathode.

EXAMPLE 2

This set of experiments used a test stand employing an anodic cell liner and slurry-electrolyte. The size liner employed in this system, permitted electrolysis experiments to be conducted typically with 100 to 300 amperes of current.

For these experiments, the liner was the only anode in the system. A single cathode was employed as shown in FIG. 4 using three dividers. The active surfaces of the cathode was made of molybdenum (Mo), and stainless steel hardware was used to hold the various parts together. The cathode was comprised of four side pieces which are held together by supporting members. Two of the side pieces measure 4"×6.5" (10.2 cm×16.5 cm) and the other two measure 3"×8.5" (7.6 cm×21.6 cm); all were 0.090" (0.23 cm) thick. When assembled, the four sides were arranged such that their adjacent outside edges were held as close to touching as practical. The outer faces of these sides were considered the active surfaces for electrolysis. The inner faces comprise sides of a chamber internal to the cathode with a cross-sectional area of about 12 $in^2$ (77.4 $cm^2$).

In addition to the main body, the cathode device used had additional members that could be added as desired. These members were each cut from the same material as the sides, and formed rectangular pieces having dimensions 2.7"×7.0" (6.9 cm×17.8 cm). A T-shaped portion was left at the top of each piece, leaving a thinner neck, while the remaining material was cut to leave a rectangular surface of dimensions 2.7"×5.0" (6.9 cm×12.7 cm). Such a piece could be placed across the two larger sides of the main rectangular cathode, parallel to the smaller sides (ends) thereof. The distance between such a suspended piece and an end could be adjusted by moving the T-shaped piece. A multiplicity of such T-shaped pieces could be inserted into the cavity. The result is a multiplicity of internal chambers, all about 3" (7.6 cm) in one dimension, but of variable second cross-sectional dimension, similar to that shown in FIG. 7. If three such pieces were equally spaced, four chambers were formed, each with a cross-sectional area of about 3 $in^2$ (19.4 $cm^2$).

With this cathode, it was possible to perform electrolysis and observe whether or not the aluminum produced on the active surfaces would flow downward to the bottom of the cathode and be pulled into the internal chambers. It was also possible to do this with various chamber sizes. In these experiments, employing electrolyte comprised of about 46 mol. % $AlF_3$, 54 mol. % NaF and 6 wt. % excess alumina at a temperature of about 760° C., amperage of 200 Å, it was found that molten aluminum deposited at the cathode would flow to the chambers in the cathode, producing a continuous aluminum pad spanning the entire cross section of the hollow cathode. The maximum width of a chamber verified to date is about 1" (2.5 cm) with length about 3" (7.6 cm), but it is believed the length can be much greater and still allow aluminum pad formation. Moreover, it was found that once such a metal pad was formed, the metal would continue to collect and be sequestered in such chambers in a manner consistent with capillary action. It was shown further that a tube could be placed into such a pad, and product metal withdrawn.

While molten metal is shown being withdrawn through the top opening in the cathode, it will be appreciated that molten aluminum can be withdrawn through the bottom opening and such is contemplated within the purview of the invention.

Thus, it will be seen that a hollow cathode can be used in an electrolysis cell for producing aluminum and the metal deposited on the cathode surfaces during electrolysis can be collected in the hollow cathode for removal to a storage area.

While the invention has been described in terms of preferred embodiments, the claims appended hereto are intended to encompass other embodiments which fall within the spirit of the invention.

What is claimed is:

1. A method of producing aluminum in an electrolytic cell containing alumina dissolved in an electrolyte, the method comprising the steps of:

(a) providing a molten salt electrolyte having alumina dissolved therein in an electrolytic cell having a liner for containing said electrolyte, said liner having a bottom and walls, said liner being substantially inert with respect to said molten electrolyte;

(b) providing a plurality of non-consumable anodes disposed substantially vertically in said electrolyte and a plurality of hollow cathodes, each cathode having a top and bottom, said cathodes disposed vertically in said electrolyte, said anodes and said cathodes arranged in alternating relationship;

(i) said anodes having a substantially plate-shaped configuration; and (ii) each of said cathodes comprised of a first side facing a first opposing anode and a second side facing a second opposing anode, said first and second sides joined by ends to form a reservoir in said hollow cathode, said cathode having a bottom opening and a top opening into said reservoir;

(c) passing an electric current from said anodes, through said electrolyte to said cathodes, depositing aluminum on said cathodes, and generating oxygen bubbles at the anodes, said bubbles stirring said electrolyte;

(d) collecting said molten aluminum deposited at said cathodes in said reservoir in the hollow cathodes; and (e) withdrawing a portion of said molten aluminum from said reservoir.

2. The method in accordance with claim 1 including maintaining 0.2 to 30 wt. % undissolved alumina in said electrolyte.

3. The method in accordance with claim 2 wherein said first and second sides of said hollow cathodes are substantially parallel to each other.

4. The method in accordance with claim 1 including operating said cell to maintain said electrolyte at a temperature less than 900° C.

5. The method in accordance with claim 1 including operating said cell to maintain said electrolyte in a temperature range of about 660°to 800° C.

6. The method in accordance with claim 1 including u sing an electrolyte comprised of one or more alkali metal fluorides.

7. The method in accordance with claim 1 wherein said anodes are comprised of an Ni—Cu—Fe alloy.

8. The method in accordance with claim 1 including passing an electric current through said cell at a current density in the range of 0.1 to 10 A/cm$^2$.

9. The method in accordance with claim 1 wherein said cathodes are comprised of a material selected from the group consisting of titanium diboride, zirconium boride, titanium carbide, zirconium carbide, molybdenum and titanium.

10. The method in accordance with claim 1 wherein first side and second side of said hollow cathodes have inside surfaces spaced at least ¼ to 3 inches from each other.

11. The method in accordance with claim 10 wherein said liner is anodic and said electric current is passed from said liner to said anodes.

12. The method in accordance with claim 1 wherein said liner is comprised of an Ni—Cu—Fe alloy.

13. The method in accordance with claim 1 wherein said liner is comprised of an Ni—Cu—Fe alloy having substantially the same composition as said anode.

14. The method in accordance with claim 1 wherein said anodes are comprised of 45–70 wt. % Cu, 25–48 wt. % Ni, and 2–17 wt. % Fe.

15. The method in accordance with claim 14 including providing a tube in said reservoir and removing molten aluminum from said reservoir using a vacuum.

16. The method in accordance with claim 1 wherein said hollow cathodes are provided with dividers in said bottom opening.

17. The method in accordance with claim 1 wherein said hollow cathodes have a rectangular-shaped cross section.

18. A method of producing aluminum in an electrolytic cell containing alumina dissolved in an electrolyte, the method comprising the steps of:

(a) providing a molten salt electrolyte in an electrolytic cell having alumina dissolved therein, the electrolyte maintained at a temperature of less than 900° C., the cell having a liner for containing said electrolyte, said liner having a bottom and walls, said liner being substantially inert with respect to said molten electrolyte, the molten electrolyte containing 0.2 to 30 wt. % undissolved alumina;

(b) providing a plurality of non-consumable anodes disposed substantially vertically in said electrolyte and a plurality of dimensionally stable cathodes, each cathode having a top and a bottom, said cathodes disposed vertically in said electrolyte, said anodes and said cathodes arranged in alternating relationship;

(i) said anodes comprised of Ni—Cu—Fe alloy; and (ii) each of said cathodes comprised of a first side facing a first opposing anode and a second side facing a second opposing anode, said first and second sides joined by ends to form a reservoir in said hollow cathode, said cathode having a bottom opening and a top opening into said reservoir;

(c) passing an electric current at a current density in the range of 0.1 to 10 A/cm$^2$ from said anodes through said electrolyte to said cathodes, depositing aluminum on said cathodes, and generating oxygen bubbles at the anodes, said bubbles stirring said electrolyte;

(d) collecting said molten aluminum deposited at said cathodes in said reservoir in the hollow cathodes; and (e) withdrawing a portion of said molten aluminum from said reservoir.

19. The method in accordance with claim 18 including operating said cell to maintain said electrolyte in a temperature range of about 660° to 800° C.

20. The method in accordance with claim 18 including using an electrolyte comprised of one or more alkali metal fluorides.

21. The method in accordance with claim 18 wherein said undissolved alumina has a particle size in the range of 1 to 100 $\mu$m.

22. The method in accordance with claim 18 wherein said Ni—Cu—Fe alloy is comprised of 15 to 60 wt. % Ni, 27 to 70 wt. % Cu, the balance consisting essentially of Fe.

23. The method in accordance with claim 18 wherein said Ni—Cu—Fe alloy is comprised of 25 to 48 wt. % Ni, 45 to 70 wt. % Cu, the balance consisting essentially of Fe.

24. The method in accordance with claim 18 including passing an electric current through said cell at a current density in the range of 0.5 to 5 A/cm$^2$.

25. The method in accordance with claim 18 wherein said hollow cathodes are comprised of a material selected from the group consisting of titanium diboride, zirconium boride, titanium carbide, zirconium carbide, molybdenum and titanium.

26. The method in accordance with claim 18 wherein first sides and second sides of said hollow cathodes have inside surfaces spaced at least ¼ to 3 inches from each other.

27. The method in accordance with claim 18 wherein said liner is anodic and said electric current is passed from said liner to said anodes.

28. The method in accordance with claim 18 wherein said liner is comprised of an Ni—Cu—Fe alloy.

29. The method in accordance with claim 18 wherein said liner is comprised of an Ni—Cu—Fe alloy having substantially the same composition as said anode.

30. The method in accordance with claim 18 wherein said hollow cathodes are provided with dividers in said bottom opening.

31. The method in accordance with claim 18 wherein said hollow cathodes have a rectangular-shaped cross section.

32. A system for producing aluminum in an electrolytic cell containing alumina dissolved in an electrolyte, the system comprised of:

(a) an electrolytic cell having a liner for containing a molten salt electrolyte having alumina dissolved therein, said liner being substantially inert with respect to said molten electrolyte;

(b) a plurality of non-consumable anodes disposed substantially vertically in said electrolyte in said cell and a plurality of hollow cathodes disposed vertically in said electrolyte, said anodes and said cathodes arranged in alternating relationship, each cathode having a top and a bottom, each of said cathodes comprised of a first side facing a first opposing anode and a second side facing a second opposing anode, said first and second sides joined by ends to form a reservoir in said hollow cathode, said cathode having a bottom opening and a top opening into said reservoir;

(c) means for passing an electric current from said anodes, through said electrolyte to said hollow cathodes, in response to passing electric current through said electrolyte, depositing aluminum on said cathodes, and generating oxygen bubbles at the anodes, said bubbles stirring said electrolyte, said aluminum deposited at said cathode collected in molten form in said reservoir; and (d) means for withdrawing a portion of said molten aluminum from said reservoir.

33. The system in accordance with claim 32 wherein the anodes are comprised of an Ni—Cu—Fe alloy.

34. The system in accordance with claim 32 wherein the anodes are comprised of Ni—Cu—Fe alloy having 15 to 60 wt. % Ni, 27 to 70 wt. % Cu, the balance comprising Fe, incidental elements and impurities.

35. The system in accordance with claim 32 wherein the anodes are comprised of Ni—Cu—Fe alloy having 25 to 48 wt. % Ni, 45 to 70 wt. % Cu, the balance comprising Fe, incidental elements and impurities.

36. The system in accordance with claim 32 wherein said hollow cathodes are comprised of a material selected from the group consisting of titanium diboride, zirconium boride, titanium carbide, zirconium carbide, molybdenum and titanium.

37. The system in accordance with claim 32 wherein said hollow cathodes have a rectangular-shaped cross section.

38. The system in accordance with claim 32 wherein said first and second sides of said hollow cathodes are substantially parallel to each other.

39. The system in accordance with claim 32 wherein said first side and said second side of said hollow cathode have inside surfaces spaced at least ¼ to 3 inches from each other.

40. The system in accordance with claim 32 wherein said cell is designed to operate with an electrolyte containing 0.2 to 30 wt. % undissolved alumina.

41. The system in accordance with claim 32 wherein said electrolyte is designed to operate at a temperature less than 900° C.

42. An improved cathode for use in a method of producing aluminum in an electrolytic cell containing alumina dissolved in an electrolyte wherein a plurality of non-consumable anodes are disposed substantially vertically in the electrolyte and a plurality of cathodes are disposed vertically in said electrolyte, said anodes and said cathodes arranged in alternating relationship, the improvement wherein:

(a) said cathodes are hollow cathodes;

(b) each of said hollow cathodes defined by a first side for facing a first opposing anode and a second side for facing a second opposing anode, said first and second sides joined by ends to form a reservoir in said hollow cathode, said cathodes having a bottom opening and a top opening into said reservoir; and (c) said cathodes are adapted for:

(i) depositing aluminum thereon upon passing an electric current from the anodes through electrolyte to the cathode and for;

(ii) collecting said molten aluminum deposited at said cathodes in said reservoir in the hollow cathodes; and (iii) withdrawing a portion of said molten aluminum from said reservoir through said top opening.

43. The method in accordance with claim 42 wherein said first and second sides of said hollow cathodes are substantially parallel to each other.

44. The method in accordance with claim 42 wherein first side and second side of said hollow cathodes have inside surfaces spaced at least ¼ to 3 inches from each other.

45. The method in accordance with claim 42 wherein said anodes are comprised of an Ni—Cu—Fe alloy.

46. The method in accordance with claim 42 wherein said cathodes are comprise of a material selected from the group consisting of titanium diboride, zirconium boride, titanium carbide, zirconium carbide, molybdenum and titanium.

* * * * *